United States Patent [19]

LeBlang

[11] 4,317,315

[45] Mar. 2, 1982

[54] INFLATABLE SHELTER

[76] Inventor: Dennis W. LeBlang, 25665 Eagle Dr., Mundelein, Ill. 60060

[21] Appl. No.: 60,572

[22] Filed: Jul. 25, 1979

[51] Int. Cl.[3] ..... E04B 1/345

[52] U.S. Cl. ..... 52/2; 156/270

[58] Field of Search ..... 52/2; 9/11 A; 156/270, 156/272

[56] References Cited

U.S. PATENT DOCUMENTS

| | | | |
|---|---|---|---|
| 2,939,467 | 6/1960 | Meyer et al. | 52/2 |
| 3,161,553 | 12/1964 | Visser | 52/2 |
| 3,960,386 | 6/1976 | Wallsten | 52/2 |
| 3,970,328 | 7/1976 | Wallsten | 52/2 |
| 3,999,333 | 12/1976 | Amarantos | 52/2 |

FOREIGN PATENT DOCUMENTS

| | | | |
|---|---|---|---|
| 1372039 | 8/1963 | France | 52/2 |
| 2305553 | 10/1976 | France | 52/2 |
| 448129 | 6/1936 | United Kingdom | 52/2 |

*Primary Examiner*—James L. Ridgill, Jr.

*Attorney, Agent, or Firm*—Hume, Clement, Brinks, Willian & Olds, Ltd.

[57] ABSTRACT

This invention relates to inflatable shelters of the kind that are formed from flexible impervious material, such as plastic, treated fabric, or the like, and which are so constructed as to embody in a unitary structure a skin for the closure and inflatable tubes constituting supporting frame ribs. In particular, the invention teaches a new and relatively inexpensive method of producing the rib tubes, particularly at their points of intersection or crossing and of establishing or avoiding the establishment of intercommunication between tubes which so intersect or cross, as may be dictated as preferred in any particular shelter structure.

8 Claims, 22 Drawing Figures

INFLATABLE SHELTER

This invention relates to shelters such as tents, covers for swimming pools, tennis courts, green houses and like structures having a skin of impervious flexible material such as sheet plastic (transparent, translucent, or opaque), treated fabric, or similar sheet materials which incorporate in their structure airtight flexible tubular ribs disposed to constitute when inflated, a supporting frame of sufficient strength to hold the structure in an erected state. The invention also relates to a novel, simple and economical method of making such structures.

BACKGROUND OF THE INVENTION

Inflatable flexible structures are old and their use has been proposed for various purposes. For example, flexible shelters have been made substantially airtight and adapted to be maintained in erected state by the constant injection of air somewhat above atmospheric pressure. Such constructions have generally been used for large enclosures such as those employed for tennis courts and other similar areas. These are relatively expensive to construct and to maintain and therefore have enjoyed somewhat limited use.

Flexible sheet shelters employing rigid supporting ribs or similar mechanical supports are generally quite expensive, heavy to transport and are quite complicated to construct and erect.

Efforts have been made to construct enclosures by employing flexible tubes properly shaped to constitute a supporting frame when inflated but insofar as this inventor is aware none of such prior structures are capable of being manufactured as simply and as economically as can the invention here disclosed. One type of such prior device has employed separate inflatable tubular frames which are first inflated and thereafter employed as a support for a separately applied skin. Another form has employed a unitary and composite frame and skin construction.

Prior to this invention insofar as this applicant is aware, it has been necessary with both forms to connect two, three or more tubular rib or frame sections together at the locations where the frame sections join or cross each other in order that the air space inside the tubular frame sections may interconnect with each other. In other words connections have been employed which though flexible are necessarily airtight and otherwise are like the connections employed for connecting pipes by means of T-connectors, cross connectors or other more complex connectors for effecting intercommunication between two or more pipes or tubes which intersect, cross, or otherwise come together.

Inflatable flexible tubular connections similar to the pipe connections above described are complicated and expensive to produce especially in view of the necessity to effect such intercommunication in a completely airtight manner.

SUMMARY OF THE INVENTION

Accordingly it is an object of this invention to provide a novel construction for such shelters which includes a skin and flexible frame producing tubes therefor which when inflated constitute supporting ribs for the shelter and which can be formd from the same skin material as a unit to constitute either the entire shelter or a part of the entire shelter adapted to interfit with one or more other similarly constructed parts to constitute the entire shelter.

Other objects are contemplated for this invention as will readily appear to one skilled in this art as the following description proceeds. For example, the method of forming the tubes as an integral part of the skin construction is an important feature of this invention as well as the structure that is produced as a result thereof.

According to one form of this invention two strips of skin material may be laid side by side with their adjacent edges overlapping an amount which permits the margins of each to be attached and sealed to the opposed surface of the other while leaving between such marginally attached and sealed areas of the overlapping skin strip an unattached area of width sufficient to constitute, when inflated, a supporting rib as may be required for that particular location.

By attaching additional strips of skin material of predetermined shape in a similar manner a base sheet of skin material incorporating a series of tubes will be formed with the tubes located at the line of juncture of each individual strip to its neighboring strip. If the skin strips are rectangular the tubes will be parallel but if it is desired to have the ribs converge at the base of the shelter so that the tubular ribs define segments of a sphere the skin strips may be appropriately shaped to that end.

According to another form of this invention the base sheet may be formed with its ribs corresponding to those formed at the juncture of adjacent strips of sheets by having a single sheet of skin material of sufficient size to constitute the entire base sheet desired and by applying to one surface thereof at spaced intervals individual rib strips which are attached and sealed at their margins while providing between the attached and sealed marginal areas an unattached area of sufficient width to provide, when inflated, the strength required for the rib being so formed.

The invention further contemplates with either of the above-described forms the production of additional inflatable ribs running in directions to intercept or extend across the ribs of the base skin sheet at any desired angle and in such cases the additional ribs are made by merely applying a rib strip of material onto the surface of the base sheet at the desired location and attaching and sealing the marginal portions of the applied strip to the base strip in the same manner described above. It is to be understood that the applied strip is of sufficient width to provide an unattached area between the marginally attached edges whereby, when inflated, a supporting rib of desired dimension and strength for the particular location of each such rib respectively is produced.

In order to establish communication between one inflatable rib forming tube and one that crosses or intersects it when applied as above described it is only necessary to cut a hole in the underlying tube at the point of intersection or crossing of the two tubes before the strip forming the crossing rib is applied and attached. This same simple procedure may be followed for any number of intersecting of crossing tubes that any particular shelter may require.

In some instances it may be desirable to provide additional width for the outer applied crossing or intersecting strips to allow sufficient unattached sheet material between the marginal attaching areas to prevent the lower rib from blocking the passage in the outer crossing or intersecting rib when expanded into it by inflation.

As will be later explained some shelters may be constructed with all of their inflatable ribs in intercommunication with each other so that when inflated the air is free to flow into all ribs until inflation is complete. However, as later explained a very desirable construction is realized by having two or more sets of ribs separately inflatable so that each set may be inflated at different times. In such cases only those ribs of a particular set are in communication with each other by means of the holes at the crossing locations above described.

DESCRIPTION OF THE PREFERRED EMBODIMENT

Reference will now be made to the drawings in which

DESCRIPTION OF THE ILLUSTRATED EMBODIMENTS

Figure 1:
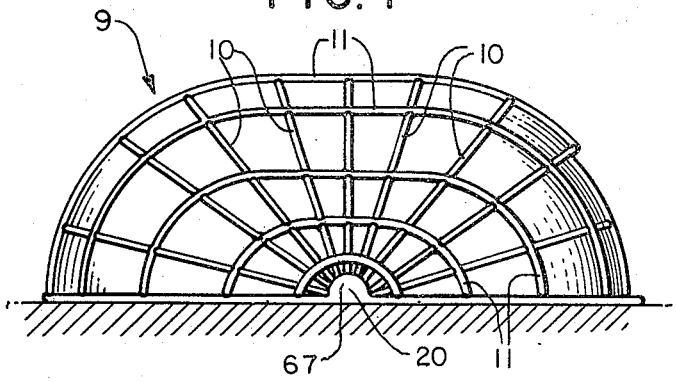
FIG. 1 is a side elevational view of one form of shelter constructed in accordance with this invention.
Figure 2:
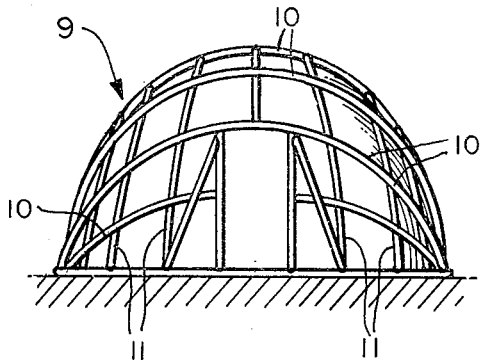
FIG. 2 is an end elevational view of the shelter shown in FIG. 1 and disclosing a doorway for the shelter.
Figure 3:
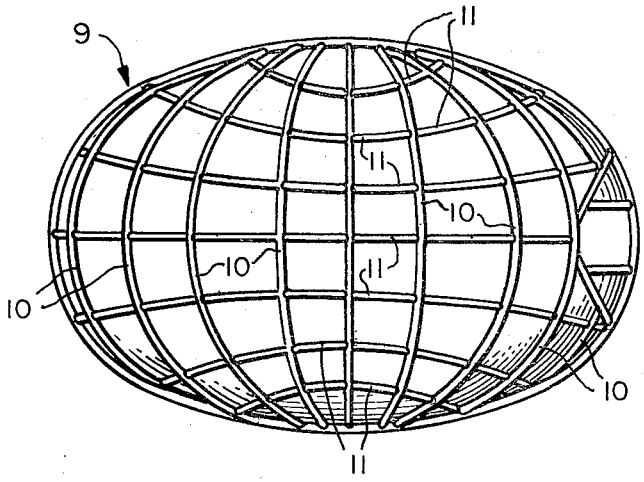
FIG. 3 is a plan view of the shelter shown in FIG. 1.

By referring to the drawings it will be noted that one form of the invention may be constructed in the manner illustrated in FIGS. 1, 2 and 3 wherein a shelter is provided which can be made of plastic sheet material such as polyvinyl chloride or polyethylene of suitable thickness and strength and which can be attached or welded to itself by heat and pressure to form the necessary seams and tubular inflatable strengthening ribs.

As shown in FIGS. 1, 2 and 3, the shelter here disclosed, designated generally as 9, may have a plurality of generally U-shaped ribs 10 which radiate from the bottom center of the side walls and extend over the top as continuous tubular ribs. In addition the shelter is provided with additional ribs 11 running generally at right angles to each of the U-shaped ribs 10 at the point where they cross or intersect the U-shaped ribs 10. In this form of the invention it is contemplated that both sets of ribs 10 and 11 are in internal communication with each other so that upon inflation of the ribs the shelter is gradually erected until all of the ribs are fully inflated.

Figure 4:
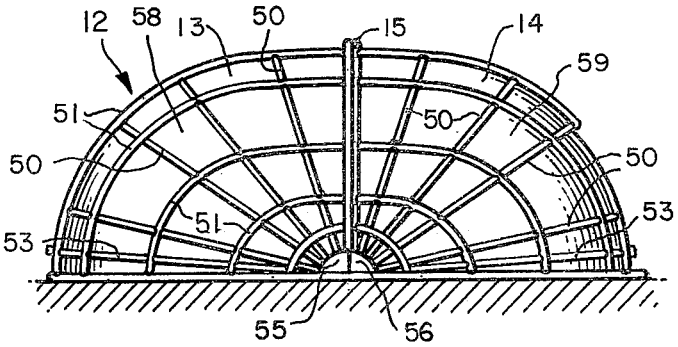
FIG. 4 is a side elevational view of a modified form of shelter constructed in accordance with this invention.

The form of the invention shown in FIG. 4 is similar to that shown in FIGS. 1, 2 and 3, except that the shelter 12 is made of two separate parts 13 and 14 which may be separately erected and laced or otherwise fastened together at their mid-juncture interface 15.

Figure 11:
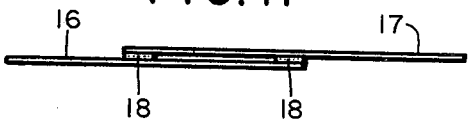
FIG. 11 is a detail fragmentary view in cross section showing the overlapped relation of adjacent strips of impervious flexible material and the marginal areas of attachment or welding of the two strips to form an inflatable tube to serve as a frame rib.
Figure 12:
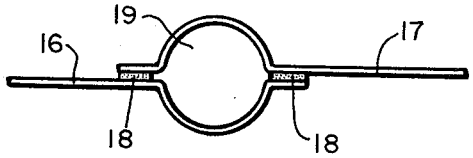
FIG. 12 is a view similar to FIG. 11 showing the same construction in an inflated state.

In both of these constructions the sheet material for the shelter may be supplied in strips of proper shape to form the skin sections between the U-shaped ribs and may be joined as by heat and pressure sealing in the manner illustrated in FIGS. 11 and 12. As there shown, adjacent edges of sheets 16 and 17 are overlapped and welded or heat sealed as at 18—18 along the entire length of the strip edges while leaving a space between the areas of the weld to provide an airtight tube 19 as shown in FIG. 12.

Figure 13:
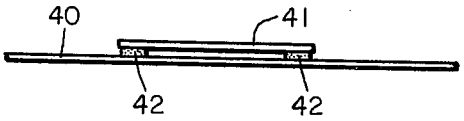
FIG. 13 is a view similar to FIG. 11 showing a modified construction for the frame rib.
Figure 14:
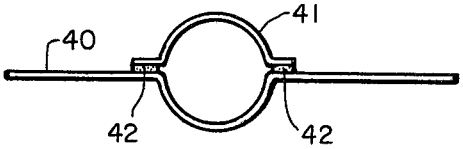
FIG. 14 is a view similar to FIG. 13 showing the same construction in an inflated state.

As shown in FIGS. 13 and 14 the base sheet can be made by supplying a single sheet 40 of plastic of size and shape to constitute the entire shelter or section thereof and providing the ribs by applying strips 41 of plastic material and welding their margins as at 42—42.

Figure 15:
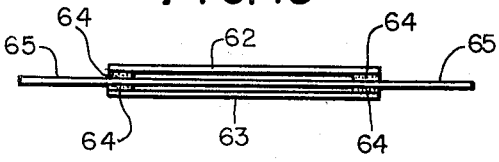
FIG. 15 is a detail fragmentary view in cross section showing a further modification of the frame ribs wherein one is formed on each side of the main sheet material of the shelter.
Figure 16:
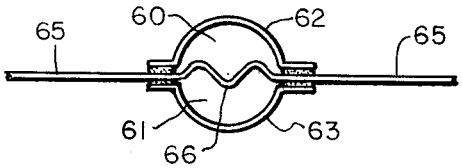
FIG. 16 is a view similar to FIG. 15 showing the same construction when inflated.

In FIGS. 15 and 16 there is shown a construction of two ribs 60 and 61 crossing or intersecting. In this case separate strips 62 and 63 are applied and attached and sealed as at 64 on opposite sides of a plastic sheet 65 as shown in FIG. 15. FIG. 16 shows the disposition of the various layers of material when the two rib tubes are inflated. If it should be desirable to provide communication between the two tubes, it would only be necessary to cut a hole through the enclosed portion 66 of the plastic sheet before the last of the two tube-forming strips is applied.

At the location of the bottom center at each side of the shelter shown in FIG. 1 the radially disposed ribs will all be in communication with each other by each having communication with the interior of a plenum chamber 67 which is formed by attaching and sealing the edges of a semicircular piece of sheet material 20 over the area of confluence of the ribs and by means of holes (not shown) cut in the tubes, respectively, inside the plenum.

Figure 17:
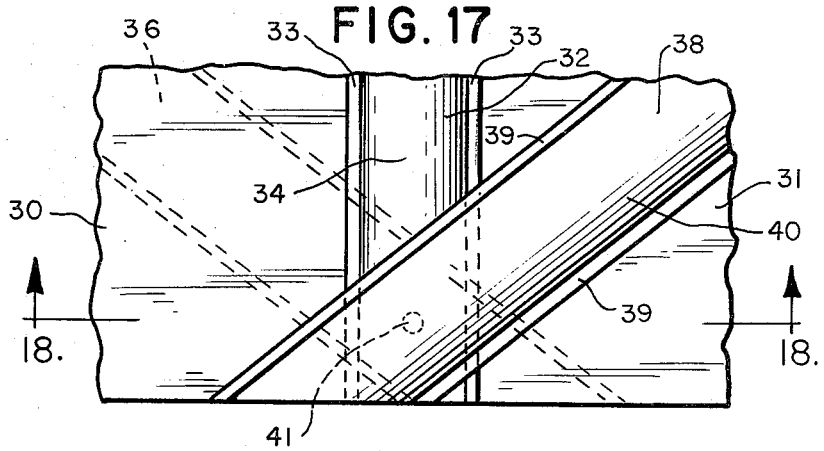
FIG. 17 is a detail view of a fragment of the shelter construction showing a portion thereof at a location where three inflatable frame ribs intersect each other.
Figure 18:
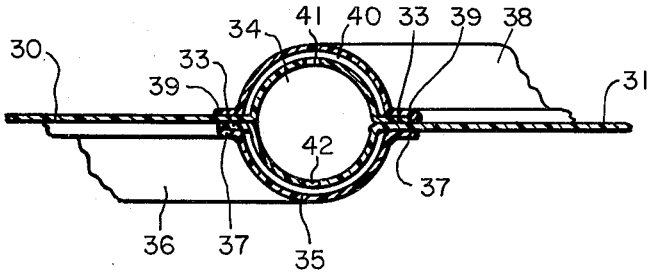
FIG. 18 is a detail cross sectional view of the tube construction shown in FIG. 17 taken on the line 18—18 of FIG. 17 and looking in the direction of the arrows.

As above stated when the rib tubes running at angles to each other intersect or cross, and it is desired to have the intersecting or crossing rib tubes in communication with each other, it is only necessary to provide a hole in the underlying tube wall at the location of the intersection or crossing. This feature of the invention is illustrated in FIGS. 17 and 18, which show three tubes intersecting. FIG. 17 shows plastic sheets 30 and 31 overlapping, and being attached and sealed at the edges 33, respectively, to form a seam and at the same time provide a rib tube as shown at 34 in FIG. 18. The additional rib tube 35 is formed by merely applying a strip of the plastic material 36 in position to cross or intersect the tube 34 in the manner shown and to attach and seal its margins as at 37—37 directly on top of the jointed strips 30 and 31 and the underlying surface of tube 34. In a similar manner strip 38 is placed in proper position on the opposite side of the plastic sheets 30 and 31 and its margins are attached as at 39—39 to provide a rib tube 40 running in a different direction. In order to provide intercommunication between the tubes it is only necessary to provide holes 41 and 42 in the surfaces of tube 34 before the strips 36 and 38 forming tubes 35 and 40 are applied and sealed. Whenever it is desirable to have separate air systems it is only necessary to omit such holes at the crossing or intersection points of the tubes and all intercommunication between then is avoided.

Figure 5:
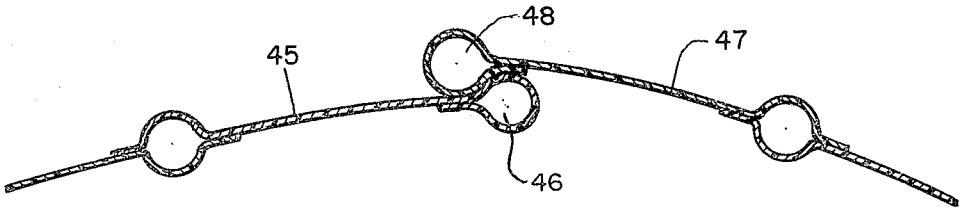
FIG. 5 is a cross-sectional view of the shelter shown in FIG. 4 having a modified structure for effecting an interlocking relationship between the two halves of the shelter.

Also in this form of the invention a modified construction for locking together the two halves of the shelter at the interface shown in FIG. 5 may be employed. By referring to this figure it will be noted that one-half designated 45 of the shelter is made slightly smaller at its end rib 46 than the dimension of the end rib 48 of the other half designated 47. When the two halves are fitted together in their proper relation and fully inflated the rib 46 of the inside half will press against the inside surface of the rib 48 of the outside half in such manner as to form a pressure seal joint between the two halves.

The construction shown in FIG. 4 preferably has its U-shaped ribs 50 formed in one-half 58 of the shelter interconnected through the plenum chambers 55 located at their confluence on opposite sides of the shelter to form one inflating system, which is not in communication with any of the longitudinal ribs 51. However, the longitudinal ribs 51 will in turn be interconnected by suitable means such as a tube 53 to provide a separate air inflating system. Each system will be provided with its own air intake nozzle 76 and valve means to allow separate inflation of each. When this construction is employed the U-shaped ribs may be first inflated or partially inflated preferably from an air intake valve means located in one or both of the plenum chambers, and thereafter the separate longitudinal ribs 51 may be inflated, preferably by a valve 76 located in the connecting tube 53 whereby each tube of the series of already inflated or partially inflated U-shaped ribs 50 will successively be moved to its final erected position as the quantity of inflating air progressively increases. The same construction and method of erection may be employed for the other half 59 of the shelter shown in FIG. 4 which also has plenum chambers 56 on each side.

Figure 6:
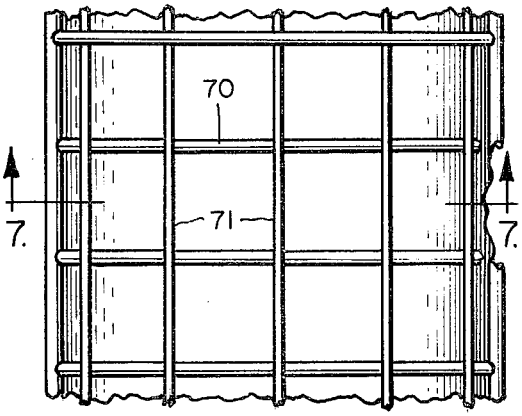
FIG. 6 is a fragmentary plan view of a modified construction of shelter made in accordance with this invention.
Figure 7:
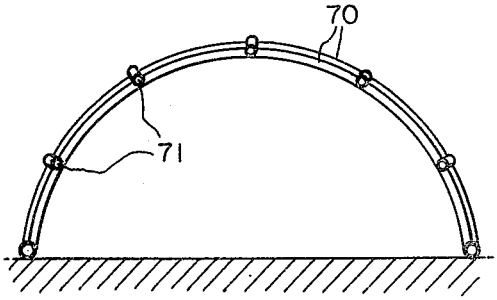
FIG. 7 is an elevational view in cross section of the shelter disclosed in FIG. 6 and taken on the line 7—7 and looking in the direction of the arrows.

Alternative forms of shelters embodying this invention are shown in FIGS. 6 and 7 where a series of ribs 70 formed as parallel arches extending transversely over the shelter are employed in association with ribs 71 which are parallel to each other and run longitudinally of the shelter. This construction can be employed with suitably formed end closures similar to the end closure 72 shown in FIG. 9 which may include on one end an access door 73.

In addition a structure like that shown in FIGS. 6 and 7 may be employed without end closures formed as a part thereof, but rather used as an intermediate section or sections placed between the two half portions 58 and 59 of the shelter construction shown in FIG. 4. In such cases the two half portions of the FIG. 4 shelter are separated to receive the intermediate portion and the interfaces of the several parts may be connected either by lacing together extending marginal tabs like that illustrated at 91 in FIG. 19, or by interfitting the mid-section inside the end sections, or vice versa, as illustrated in FIG. 5.

Also, this construction may be used with all of the ribs 50 and 51 in communication for a one-step erecting process. However, it can be constructed with the U-shaped ribs 50 only in communication to form one inflatable system and the longitudinal ribs 51 only in communication to form a second inflatable system with the result that jointly a two-step erecting procedure is made possible.

Figure 9:
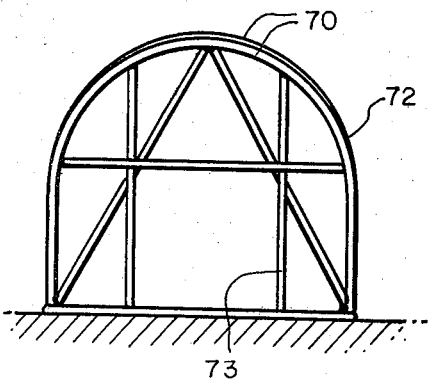
FIG. 9 is an end elevational view of the shelter shown in FIG. 8.
Figure 8:
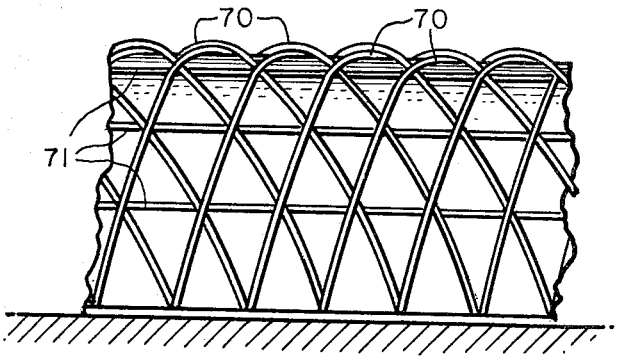
FIG. 8 is a fragmentary side elevational view of another modification of the shelter made in accordance with this invention.
Figure 10:
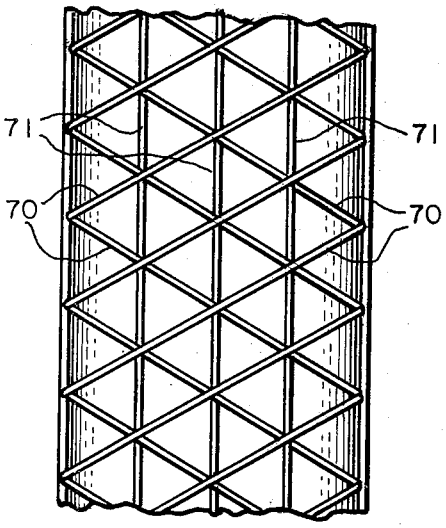
FIG. 10 is a fragmentary plan view of the shelter disclosed in FIG. 8.

FIGS. 8, 9 and 10 show a further modification of rib arrangement for shelters of this invention. In this case the U-shaped ribs 70 are disposed at a 60° angular relationship to the longitudinal ribs 71. Here, as in the construction shown in FIGS. 6 and 7, the ends of the shelter may be closed with an end construction such as shown in FIG. 9 or the construction may serve as a separate intermediate section to provide a multi-part shelter by cooperative association with the two halves 58 and 59 of the shelter shown in FIG. 4. Also, this form of the invention may be made for either a one-step or a two-step erecting process as above described by having either one or two inflatable systems.

Figure 19:
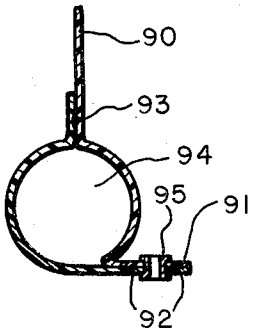
FIG. 19 is a detail fragmentary view in cross section of a construction that may be used for the bottom edge of a shelter made in accordance with this invention.

Referring now to FIG. 19 it will be understood that the bottom of the shelter wall may be formed to provide an inflated rib 94 at the base of the wall at the location where the wall is to be anchored to the ground or other surface on which the shelter rests. This is accomplished by having the plastic sheet 90 folded back on itself in such a way as to provide an end tab 91 of double thickness welded together as at 92 and providing a further weld at 93 between the end of the doubled back portion and the sheet 90, all in such a way to provide the unattached area between the welds of a dimension sufficient to provide a rib tube 94 of proper strength. The tab 91 is preferably provided with holes and grommets 95 to permit the tab to be fastened down to the underlying surface.

Figure 20:
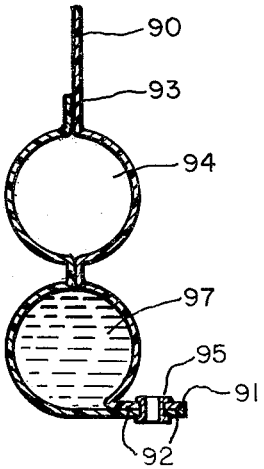
FIG. 20 is a detail fragmentary view in cross section of a modified construction employing water in the lower rib that may be used for the bottom edge of a shelter made in accordance with this invention.

The construction disclosed in FIG. 20 is similar to that shown in FIG. 19 except that two rib tubes 94 and 97 are formed instead of one. In this case the lowermost rib 97 is adapted to hold water in order to provide the weight of the contained water to assist in holding the shelter in place. In cases where the use of water in the bottom rib is desirable, the construction shown in FIG. 19 can in many instances be used with the change only of having the rib 94 out of communication with the air supply and being adapted to receive and hold water.

It should be understood that when lacing is employed with the form of the invention disclosed in FIG. 4, tabs having holes and grommets as shown in FIGS. 19 and 20 at 95 may be provided at the mating edges of the two halves 58 and 59 of the shelter. Other attaching means can be used in place of the grommets and lacings such as snaps, zippers or other mechanical fasteners.

Figure 21:
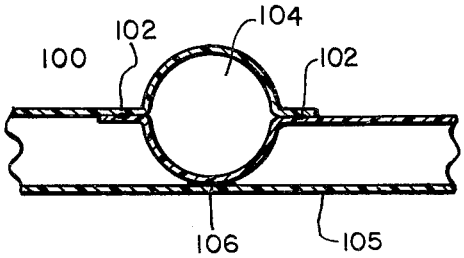
FIG. 21 is a detail fragmentary view in cross section of a modified form of shelter construction having a double wall associated with an inflated frame rib.

The construction shown in FIG. 21 is similar to that shown in FIG. 12 with the exception that an additional plastic sheet is utilized in order to provide a double wall for insulation purposes. As shown in the drawing, plastic sheets 100 and 101 are overlapped and welded at 102—102 to form a seam and a rib tube 104. In addition, another separate plastic sheet 105 is welded tangentially as at 106 to the outer surface of the tube 104 to form dead air space between adjacent tubes in the shelter wall structure.

Figure 22:
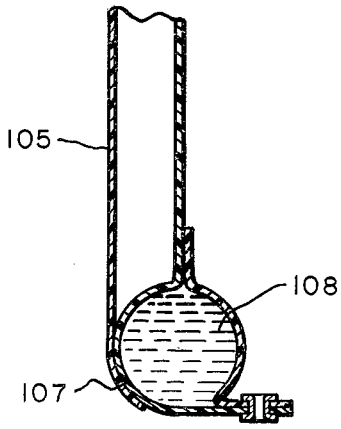
FIG. 22 is a similar view of the lower portion of the same double wall construction associated with the lower edge or water rib of the shelter of this invention.

FIG. 22 shows a construction similar to that illustrated in FIG. 19 with the exception that here also the double insulating wall like that illustrated in FIG. 21 is provided. This figure shows how the additional sheet of plastic 105 of FIG. 21 may be attached to the bottom rib, whether such rib is filled with air or water. As shown, the sheet 105 is welded as at 107 to the outer surface of the bottom rib tube 108 to create a double wall as shown.

In the drawings no attempt has been made to show the air injection valves, but it is to be understood that their use is contemplated and they may be provided in any desired number and placed at any suitable locations.

In the following claims the term "welded" is intended to mean closely united or joined, or formed into or as if formed into a single piece or unit.

I claim:

1. A shelter or part thereof of the type having as a unitary structure a flexible skin and a plurality of flexible inflatable tubes which when inflated act as supporting ribs for said flexible skin, comprising a flexible skin of impervious material having elongated portions sealed in a manner forming a first set of a plurality of tubular ribs so located as to leave the other portions of said flexible skin disposed so as to serve as the enclosing skin between said tubular ribs; and a second set of additional tubular ribs crossing said first set, said second set being formed of portions of said flexible skin and strips of flexible impervious material capable of being welded to said flexible skin and of a width such that when their marginal portions are welded to said flexible skin the unattached areas, respectively, between such welded margins are adequate to constitute the desired tubular ribs, said strips being applied directly to said flexible skin and on the side thereof opposite to that on which said first set of ribs are formed and across portions of said first set of tubular ribs with their marginal edges respectively welded to said flexible skin and means for introducing air into said two sets of ribs.

2. A shelter or part thereof having the construction defined in claim 1 further characterized in that there is a third set of additional tubular ribs crossing said first and second sets of tubular ribs, said third set being formed of portions of said flexible skin and portions of said second set of tubular ribs and additional strips of flexible impervious material capable of being welded to said flexible skin and of a width such that when their marginal portions are welded to said base sheet the unattached areas thereof, respectively, between such welded margins are adequate to constitute the desired tubular ribs, said strips being applied directly to said flexible skin and across portions of said first and second sets of tubular ribs with their marginal edges respectively welded to said flexible skin and to the surfaces of the particular tubular ribs underlying the locations of said crossings and means for introducing air into said third set of ribs.

3. A shelter or part thereof having the construction defined in claim 2 further characterized in that intercommunication is provided between the three sets of ribs by holes placed in the material comprising said first and second sets of tubular ribs at the locations respectively where said first, second and third sets of ribs cross or intersect each other.

4. A shelter or part thereof of the type having as a unitary structure a flexible skin and a plurality of flexible inflatable tubes which when inflated act as supporting ribs for said flexible skin, comprising a flexible skin of impervious material having elongated portions sealed in a manner forming a first set of a plurality of tubular ribs so located as to leave the other portions of said flexible skin disposed so as to serve as the enclosing skin between said tubular ribs; and a second set of additional tubular ribs crossing said first set, said second set being formed of portions of said flexible skin and strips of flexible impervious material capable of being welded to said flexible skin and of a width such that when their marginal portions are welded to said flexible skin the unattached areas, respectively, between such welded margins are adequate to constitute the desired tubular ribs, said strips being applied directly to said flexible skin and across portions of said first set of tubular ribs with their marginal edges respectively welded to said flexible skin and to the surfaces of the particular tubular ribs underlying the locations of said crossings, and means for introducing air into said two sets of ribs.

5. A shelter or part thereof having the construction defined in claim 4 further characterized in that intercommunication is provided between the two sets of ribs by holes placed in the material comprising said first set of tubular ribs at the locations respectively where said first set of ribs and said second set of ribs respectively cross each other.

6. A shelter or part thereof having the construction defined in claim 4 further characterized in that an additional sheet of flexible material is welded tangentially to one of the sides of said rib surfaces to provide when the ribs are inflated a double wall enclosing space between said additional sheet and said base sheet.

7. The method of forming a shelter or part thereof having as a unitary structure a flexible skin of impervious material and a plurality of inflatable tubes which act as supporting ribs when inflated which includes the step of applying to a flexible skin having a first set of non-crossing tubular ribs formed therein, a plurality of strips of sheet material disposed so as to cross the ribs of said first set, said strips being applied flat and thereupon welding their marginal edges to the underlying portions of said flexible skin and tubular ribs while leaving sufficient unattached area between said marginal welds to constitute supporting ribs respectively when the tubes so formed are inflated.

8. The method defined in claim 7 further characterized in that before said strips are applied and welded to said flexible skin cutting holes in the underlying tubular ribs formed in said flexible skin at the locations respectively where said strips cross said underlying tubular ribs, whereby a structure results in which all the ribs so produced will be in communication with each other.

* * * * *